United States Patent [19]

Koshizawa et al.

[11] Patent Number: 4,773,370

[45] Date of Patent: Sep. 27, 1988

[54] FUEL CONTROL SYSTEM FOR INTERNAL COMBUSTION ENGINE

[75] Inventors: Toshifumi Koshizawa, Kawasaki; Hiroshi Yoshimura, Yokohama; Toshiya Sugimura, Numazu, all of Japan

[73] Assignees: Isuzu Motors Limited, Tokyo; Fujitsu Limited, Kawasaki, both of Japan

[21] Appl. No.: 61,775

[22] Filed: Jun. 15, 1987

[30] Foreign Application Priority Data

Jun. 13, 1986 [JP] Japan ..... 61-137791

[51] Int. Cl.[4] ..... F02D 1/08

[52] U.S. Cl. ..... 123/357; 123/359; 123/399

[58] Field of Search ..... 123/339, 357, 358, 359, 123/399; 73/119 A

[56] References Cited

U.S. PATENT DOCUMENTS 4,491,112 1/1985 Kanegae et al. ..... 123/359 X
4,493,303 1/1985 Thompson et al. ..... 123/357
4,502,437 3/1985 Voss ..... 123/357
4,546,736 10/1985 Moriya ..... 123/399 X
4,619,233 10/1986 Yamaguchi ..... 123/357
4,619,234 10/1986 Okamoto ..... 123/357

*Primary Examiner*—Tony M. Argenbright
*Assistant Examiner*—Eric R. Carlberg
*Attorney, Agent, or Firm*—Staas & Halsey

[57] ABSTRACT

The number of steps required for a step motor to reach a target load is computed by dividing in proportion the number of steps required for the step motor to move a fuel metering member to move from an idle position to a full-load position by a ratio between a target load value of an electric command given by fuel supply command means such as an accelerator pedal to an internal combustion engine and a maximum value of the electric command. The step motor is driven by the computed step number to correct variations in the characteristics of the fuel supply command means. The number of load estimation steps for the step motor driven by drive means is determined by dividing in proportion an electric maximum command given from the fuel supply control means by a ratio between the actual amount of rotation of the step motor and the amount of rotation from the idle position to the full-load position, and a step-out condition of the step motor is detected from the estimation step number.

10 Claims, 6 Drawing Sheets

FUEL CONTROL SYSTEM FOR INTERNAL COMBUSTION ENGINE

CROSS-REFERENCE TO RELATED APPLICATION

Japanese Patent Application No. 58-118538 (Japanese Laid-Open Patent Publication No. 60-11642) is concerned with an invention for correcting an error in the amount of fuel supplied to an internal combustion engine in relation to the amount of depression of an accelerator pedal of the engine which drives a motor vehicle.

BACKGROUND OF THE INVENTION 1. (Field of the Invention)

The present invention relates to a fuel control system for an internal combustion engine, and more particularly to a fuel control system for controlling the control lever of a fuel injection pump in an internal combustion engine.

2. (Description of the Prior Art)

Some modern fuel control systems for automotive internal combustion engines do not drive the rack of a fuel injection pump or the valve of a carburetor directly in response to depression of an accelerator pedal, but read the amount of depression of the accelerator pedal as an electric value, and energize a step motor according to the amount of depression expressed by the electric value for controlling the amount of fuel to be supplied to the engine.

FIG. 6 shows a portion of a device for controlling fuel to be supplied to an internal combustion engine, using a step motor. A control lever 5 attached to a governor 3 of an internal combustion engine 4 for a diesel engine is coupled to a step motor 1 by a rod 10. The control lever 5 is operated by the step motor 1, and is normally biased toward its initial position by a return spring 2. The control lever 5 is movable in a range which is limited between an idle stopper 6 and a full-load stopper 7, the range limits of the control lever 5 being detected respectively by an idle position switch 8 and a full-load position switch 9. Although parts associated with an accelerator pedal are not shown in FIG. 6, the amount of depression of the accelerator pedal is normally read by a potentiometer, and the amount of depression (analog quantity) as read by the potentiometer is converted by an analog-to-digital converter to a digital quantity which is used to energize the step motor 1. The number of steps through which the step motor 1 is rotated is controlled linearly in response to the amount of depression of the accelerator pedal. The number of steps is read by a step number counter in an electronic control unit (not shown) in the form of a microcomputer, so that the present position of the step motor is recognized in the electronic control unit at all times.

FIG. 8 is a flowchart of a control sequence of the step motor. The value of the step number counter for the step motor and a target step number are compared with each other, and the following control is effected dependent on the result of comparison:

(1) If the value of the step number counter is smaller than the target step number, then the value of the step number counter is incremented by +1 to drive the step motor through +1 step, and the value of the step number counter and the target step number are compared with each other again.

(2) If the value of the step number counter is greater than the target step number, then the value of the step number counter is decremented by 1 to drive the step motor through −1 step, and the value of the step number counter and the target step number are compared with each other again.

(3) If the value of the step number counter is equal to the target step number, then whether the target step number is 0 or not is checked. If no, then the step motor is held in position. If yes, then control enters an idle process in which the step number counter is cleared to 0, and the step motor is de-energized.

In such fuel control system for an internal combustion engine, the potentiometer is employed to detect the amount of depression of the accelerator pedal. However, the detected output of the sensor suffers errors due to irregular resistance characteristics of individual potentiometers, and hence the amounts of fuel supplied to internal combustion engines become uneven. Japanese Laid-Open Patent Publication No. 60-11642, as referred to above, proposes a system for preventing variations in the amount of supplied fuel due to irregular resistance characteristices of potentiometers.

The disclosed fuel control system for internal combustion engines has however not taken into consideration any correction of variations in the amounts of fuel supplied by individual fuel supply devices. More specifically, such a problem will be described with reference to a diesel engine, for example. As shown in FIG. 9, the number of steps between idle and full-load positions for a fuel injection pump varies from pump to pump. Since however the corrected number of steps issued from the analog-to-digital converter with respect to the depressed position of the accelerator pedal is solely determined as shown in FIG. 7, different power outputs may be produced from different internal combustion engines even when their accelerator pedals are depressed to the same position. Take, for example, two governors having different angles between idle and full-load positions, with the numbers of steps between the idle and full-load positions being expressed respectively by S1, S2. For controlling the governors under a ½ load, the required angle COM of rotation of the step motor is $S\frac{1}{2}$ for the former governor and S2/2 for the latter governor. This holds true for a fuel supply device for an internal combustion engine using gasoline as fuel.

Accordingly, it is an object of the present invention to provide a fuel control system for an internal combustion engine, which is capable of controlling a step motor so that the same engine output will be produced in response to the same accelerator pedal position even if different angles are present between idle and full-load positions.

Another object of the present invention is to provide a fuel control system for an internal combustion engine, which is capable of preventing a step motor that drives a fuel supply device from a step-out condition.

Still another object of the present invention is to provide a fuel control system for an internal combustion engine, which prevents the internal combustion engine from running out of control even when the fuel control system fails.

SUMMARY OF THE INVENTION

To achieve the above objects of the present invention, there is provided a fuel control system for an internal combustion engine having fuel supply means for metering fuel to be supplied to the engine in response to an electric command given by fuel supply command means, the fuel control system comprising a step motor for driving a fuel metering member of the fuel supply means, learning means for learning the number of steps required for energizing the step motor to move the fuel metering member from an idle position to a full-load position, computing means for computing the number of steps required for the step motor to reach a target load position by dividing in proportion the learned number of steps by a ratio between a target load value of an electric command from the fuel supply command means and a maximum value of the electric command, and drive means for energizing the step motor with the number of steps computed by the computing means.

There is also provided a fuel control system for an internal combustion engine having fuel supply means for metering fuel to be supplied to the engine in response to an electric command given by fuel supply command means, the fuel control system comprising a step motor for driving a fuel metering member of the fuel supply means, learning means for learning the number of steps required for energizing the step motor to move the fuel metering member from an idle position to a full-load position, first computing means for computing the number of steps required for the step motor to reach a target load position by dividing in proportion the learned number of steps by a ratio between a target load value of an electric command from the fuel supply command means and a maximum value of the electric command, drive means for energizing the step motor with the number of steps computed by the computing means, second computing means for determining the number of load estimation steps for the step motor to be driven to a prescribed position by dividing in proportion an electric maximum command from the fuel supply means by a ratio between the actual amount of rotation of the step motor and the amount of rotation from the idle position to the full-load position, and detecting means for comparing the number of load estimation steps for the step motor computed by the second computing means and the number of steps computed by the first computing means, and for detecting a step-out condition of the step motor when the difference between the compared numbers is greater than a preset value.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

An embodiment of the present invention will hereinafter be described with particular reference to fuel control for a diesel engine.

Figure 1:
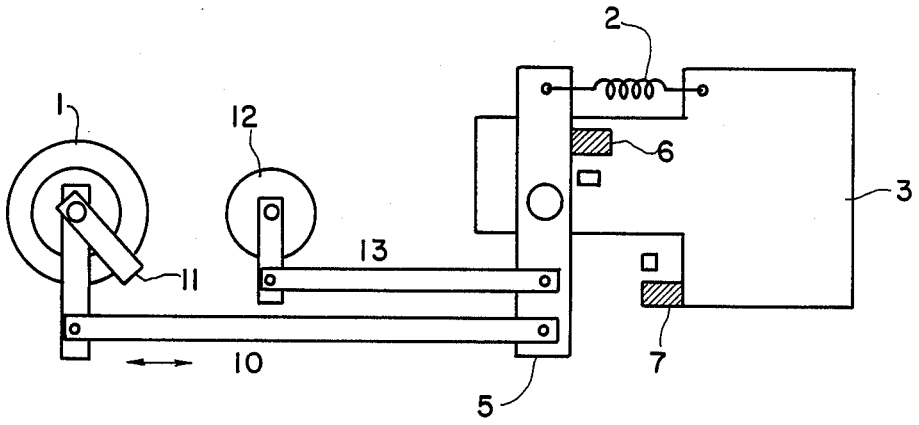
FIG. 1 is a schematic view of a governor for controlling fuel to be supplied to a diesel engine and a step motor for driving the control lever of the governor.

As shown in FIG. 1, a step motor 1 is rotated stepwise according to pulses supplied from a control unit (not shown in FIG. 1), described later. A governor 3 supports thereon a control lever 5 having one end coupled to the governor 3 by a return spring 2 which normally biases the control lever 5 to an idle position. The governor 3 has an idle stopper 6 for limiting rotation of the control lever 5 toward the idle position and a full-load stopper 7 for limiting rotation of the control lever 5 toward a full-load position.

The control lever 5 and the step motor 1 are interconnected by a rod 10. A load sensor 12 comprising a potentiometer serves to detect the angle of rotation of the control lever 5, which is connected to the load sensor 12 by a rod 13. The load sensor 12 issues prescribed voltages to detect engine loads at the idle and full-load positions of the control lever 5. When the engine output is of a full-load condition, the control lever 5 is required to abut against the full-load stopper 7. The step motor 1 has a drive shaft to which a cancel lever 11 is attached so that the drive shaft of the step moto 1 is prevented from idly rotating and the step motor 1 is prevented from a step-out condition when the control lever 5 engages the full-load stopper 7 and keeps on engaging the full-load stopper 7 upon further energization of the step motor 1.

Figure 2:
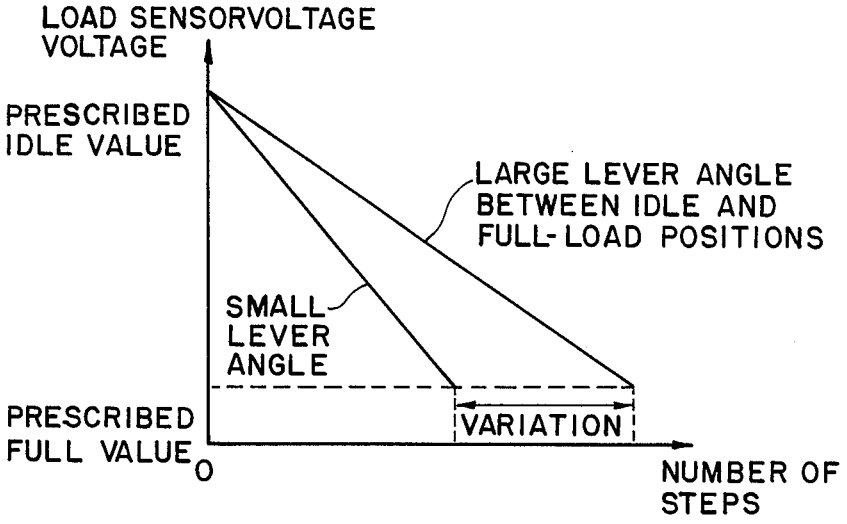
FIG. 2 is a graph showing the relationship between the number of steps required to rotate the control lever of each governor and the angle of rotation of the control lever corresponding to the step number, i.e., the output voltage of a load sensor.

FIG. 2 shows the relationship between the number of steps required to rotate the control lever of each of governors used and the angle of rotation of the control lever corresponding to the given number of steps, i.e., the output voltage of the load sensor. The angle of rotation of the control lever between the idle position and the full-load position varies from governor to governor. According to the present invention, the load sensor voltage value at the idle position and the number of steps through which the step motor 1 rotates to the full-load position as defined by the load sensor voltage value are learned for each governor, and variations in the number of steps required to rotate the control lever between the idle and full-load positions are corrected on the basis of the learned values, so that fine control in the vicinity of the idle position, prevention of a step motor step-out condition, and hunting-free smooth control can be accomplished. The process of correcting the variations will later be described in detail.

Figure 3:
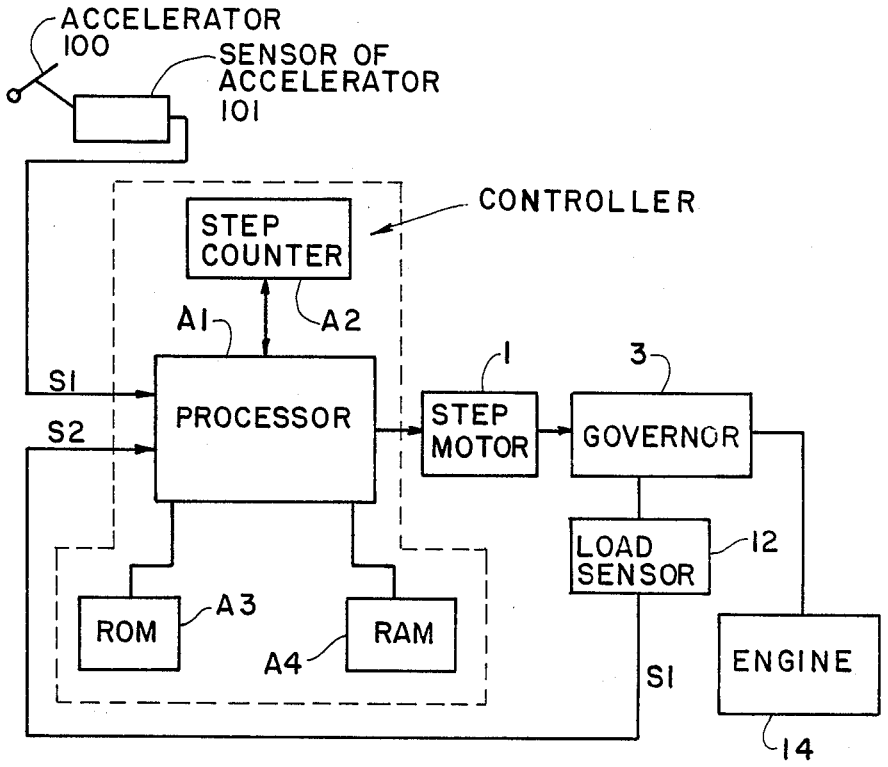
FIG. 3 is a block diagram of a control arrangement of a fuel control system according to the present invention.

FIG. 3 shows in block form a control arrangement of the fuel control system of the present invention. A control unit A is in the form of a microcomputer including a processor A1, a step number counter A2 for counting pulses to be applied to the step motor 1, a read-only memory (ROM) A3 for storing a program which needs no change, such as a system program, and data which need no change, and a random-access memory (RAM) A4 for storing data. The RAM A4 is backed up by a battery, so that the stored data will not be erased even when the power supply for the control unit is switched off or fails. The control unit A also includes an I/O device which is not shown in FIG. 3 as it is not necessary for the description of the present invention.

The amount of depression of an accelerator pedal 100 is detected by an accelerator pedal sensor 101 including a potentiometer for detecting the amount of depression of the accelerator pedal 100, an analog-to-digital converter for converting an analog voltage from the potentiometer to a digital value, and a compensator for compensating for variations in the quality of the potentiometer. The range between idle and full-load positions of the accelerator pedal 100 is divided into $0 through $FF. The accelerator pedal sensor 101 issues a signal S2 of a target load representative of the amount of depression of the accelerator pedal 100 and applies the signal S2 to the control unit A.

The control unit A has means for learning, in advance, the number of steps through which the step motor is to rotate, and means for correcting the number of steps. The control unit A is supplied with a voltage signal S1 from the load sensor and the signal S2 and effects prescribed signal processing for producing a signal for driving the step motor 1.

The signal processing by the control unit A is carried out as follows:

(1) Reception of a target load command by the control unit A:

The target load command is applied to the control unit A as a command value indicative of the amount of depression of the accelerator pedal 100 and delivered from the accelerator pedal sensor 101, and represents a position between the idle and full-load positions with value:

($0–$FF)

(2) The target load command given is corrected into a value inherent in each governor.

(3) The step motor is energized by the corrected value.

More specific control of the step motor 1 will be described below.

In the adjustment procedure immediately after the governor has been manufactured, the output voltage issued from the load sensor 12 is adjusted as follows:

Adjusted load sensor value [V] (error range)

(a) Idle position . . . +2.35 V (+0 V-−0.12 V) (b) Full-load position . . . +0.15 V (+0.06 V-−0 V) The learning operation when the governor 3 is in the idling and full-load conditions, and the processing for operating the engine in other cases, i.e., according to the amount of depression of the accelerator pedal, is effected as follows:

(1) The learning process when the accelerator pedal is in the idle position:

When the target load is 0 (i.e., the accelerator pedal is in the idle position), the step motor is de-energied, and thereafter the fact that the load sensor voltage is of a prescribed value [in the above example, within 2.35 V (+0 V-−0.12 V)] is confirmed. The load sensor voltage at that time is stored in the RAM A4, and simultaneously the step number counter A2 is reset.

(2) The learning process when the accelerator pedal is in the full-load position:

The step motor 1 is driven from the idle positoin in a positive direction (from idle to full-load position), and when the load sensor voltage reaches a maximum value (in the above example, 0.21 V) of the prescribed full-load value, the step motor is de-energized and held in position.

During this time, each time the step motor 1 is incremented one step, the step number counter A2 is also incremented one step. The value of the step number counter A2 at that time is stored in the RAM A4.

Upon completion of the above processing, the step motor 1 is quickly driven in the positive direction through a prescribed number of steps (7 steps for example) to ensure that the control lever will reliably engage the full-load stopper. Thereafter, the step motor 1 is held in position.

(3) Normal processing operation:

Based on the load sensor voltage when the control lever is in the idle position, as determined in the above learning processes (1) and (2), the total number of steps from the idle to the full-load position, and the target load command given by the accelerator pedal sensor 101, the following computation is effected in the control unit A. In driving the step motor 1, the step number counter is incremented or decremented dependent on whether the step motor is rotated in the forward or reverse direction.

(a) Computation of the present load value:

(1) Present load position=$FF×[{(load sensor voltage upon idling)−(present load sensor voltage)}/{load sensor voltage upon idling)−0.21 V)}]

However, if the load sensor voltage is equal to or smaller than 0.21 V, then (present load value)=$FF.

Or, (2) Present load position=$FF×{(the number of steps from the idle position to the present position)/(the total number of steps from the idle position to the full-load position)}

(b) The number of steps from the idle position to the target load:

(the number of steps up to the target load)=(the total number of steps from the idle position to the full-load position)×{(target load)/($FF)}

The number of steps corresponding to the amount of depression of the accelerator pedal 100 is corrected by the result of computation in (b), and the step motor 1 is energized by the corrected number of steps.

(b) indicates the target number of steps for driving the step motor, and is compared with the content of the step number counter A2. When they are equal to each other, the step motor is held in position.

When the step motor is held in position, the number of estimation steps in the present load sensor voltage is computed back from (b) above, and is compared with the value of the step number counter A2. If the difference is within a preset range, it is confirmed that the step motor is not in a step-out condition, but is operated normally.

If the step motor is judged as being in a stepout condition, then the target load is cleared to zero and the step motor 1 is de-energized. The step number counter A2 is then reset, and the step motor 1 is quickly driven again to the target load.

Figure 4:
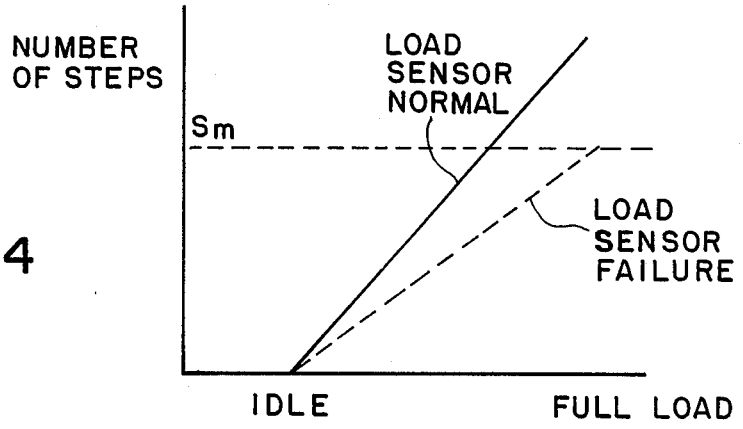
FIG. 4 is a graph illustrating the manner in which the number of steps is reduced when the load sensor fails.

FIG. 4 explains the manner in which the control lever is controlled. In normal condition, the number of steps through which the step motor 1 is to rotate between the idle and full-load positions is learned, as described above, and the gradient of a load-sensor-voltage vs.

stepnumber curve is corrected. When the load sensor fails, the learning of the step number is inhibited, the maximum step number is limited to Sm, and the learned step number is replaced with Sm to execute control in an emergency. The maximum step number Sm is determined by a minimum value of variations in the angle of rotation of the control lever of the fuel injection pump.

Figure 5:
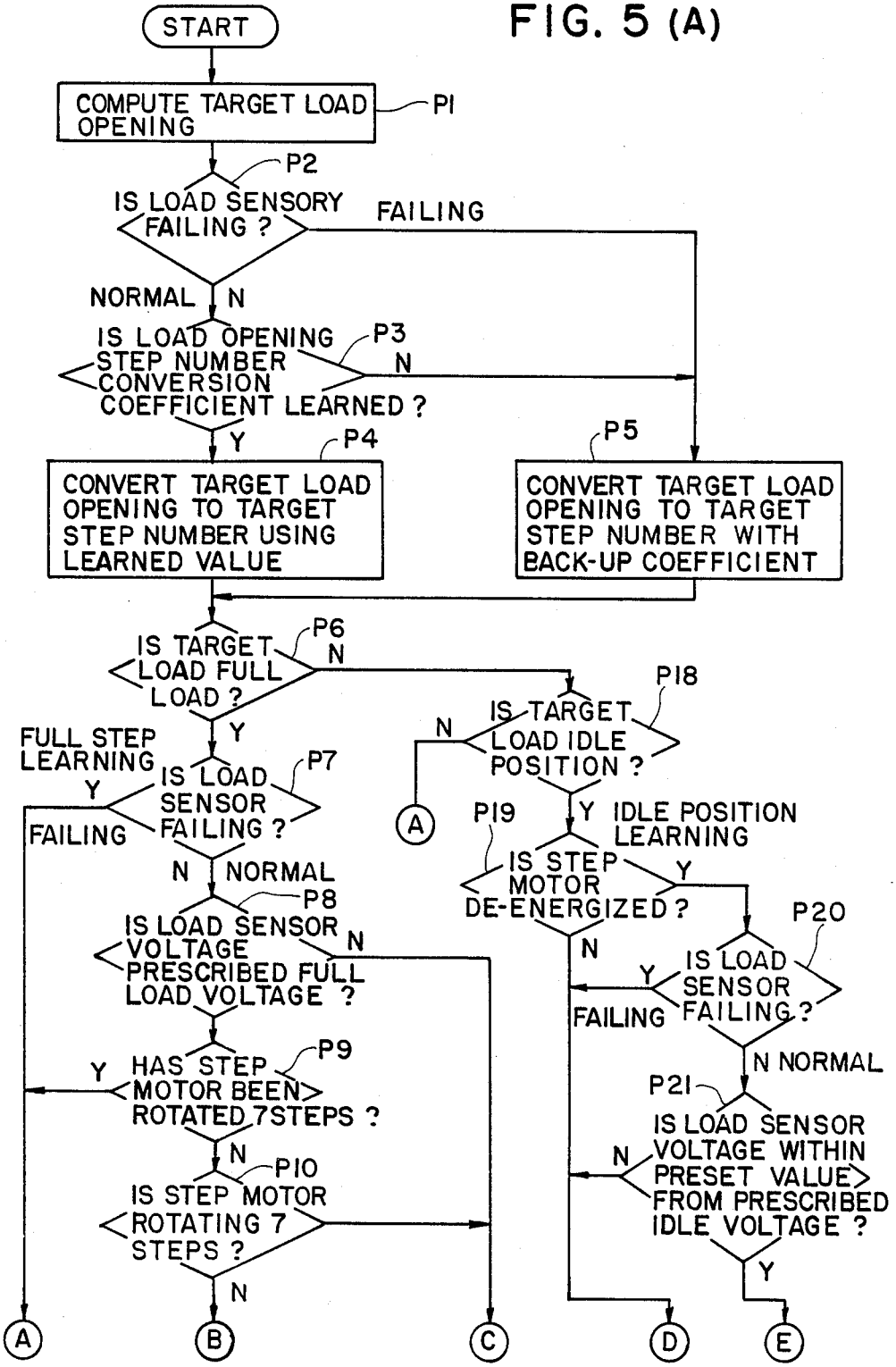
FIGS. 5(A) and 5(B) are a flowchart of an operation senquence of the fuel control system.
Figure 5:
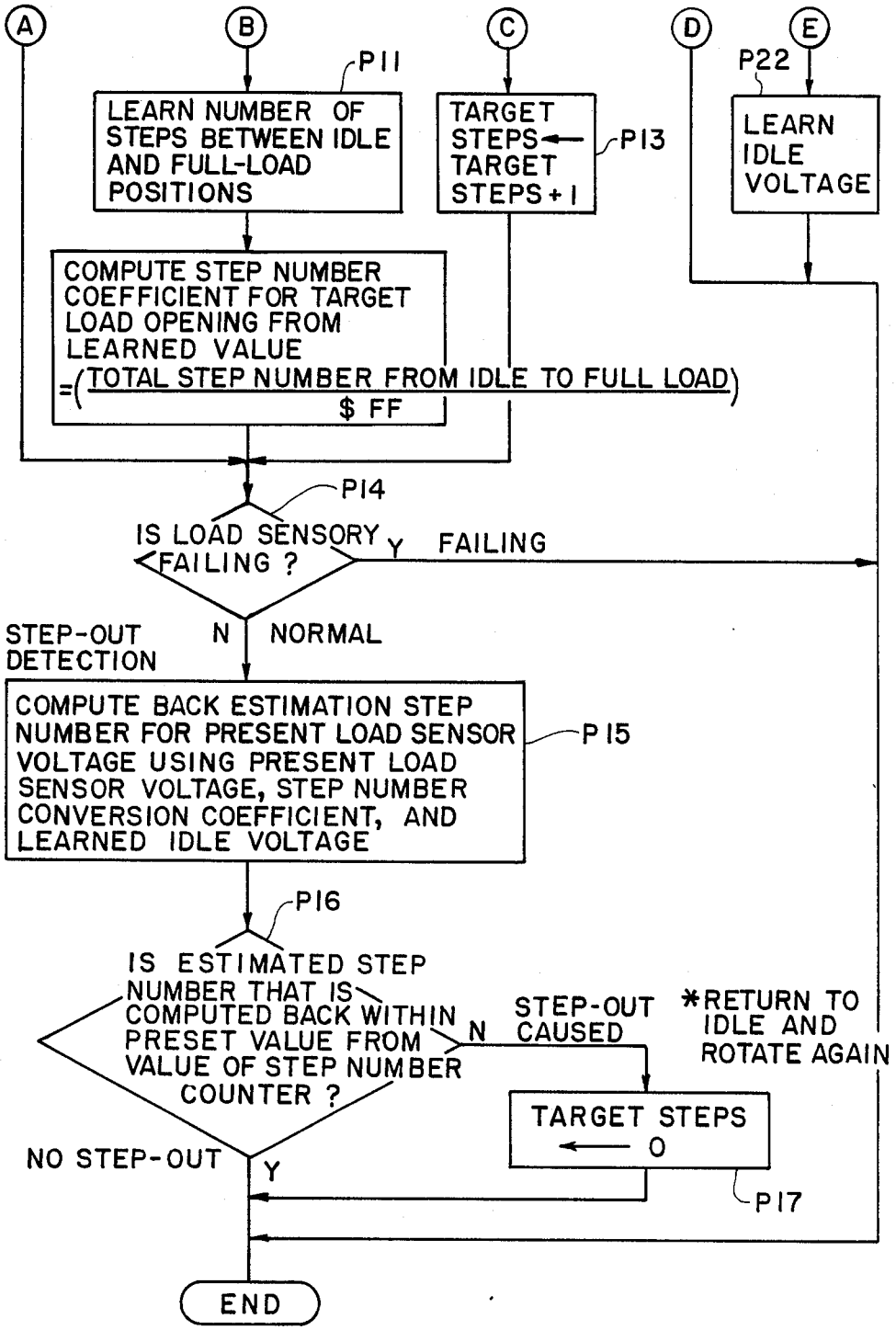
Figure 6:
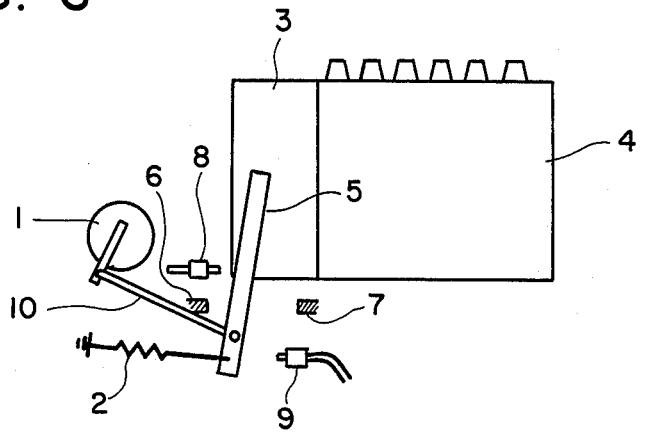
FIG. 6 is a schematic view of a conventional governor.
Figure 7:
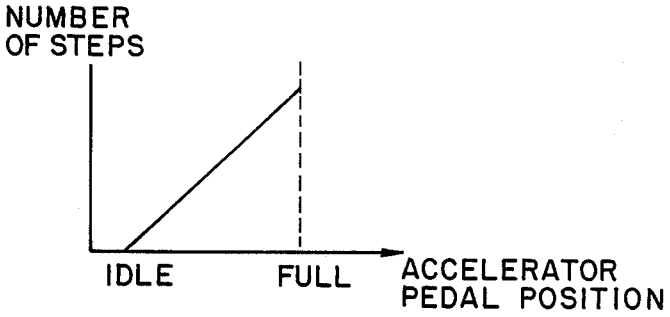
FIG. 7 is a graph showing the relationship between the amount of depression of an accelerator pedal and the number of steps through which a step motor rotates.
Figure 9:
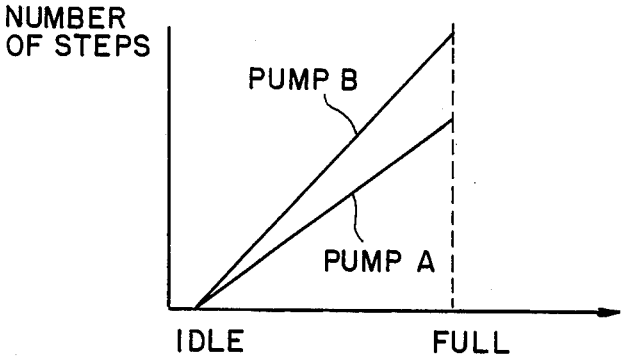
FIG. 9 is a diagram illustrating the relationship between the angle of the control lever of a governor and the number of steps through which the step motor rotates.
Figure 8:
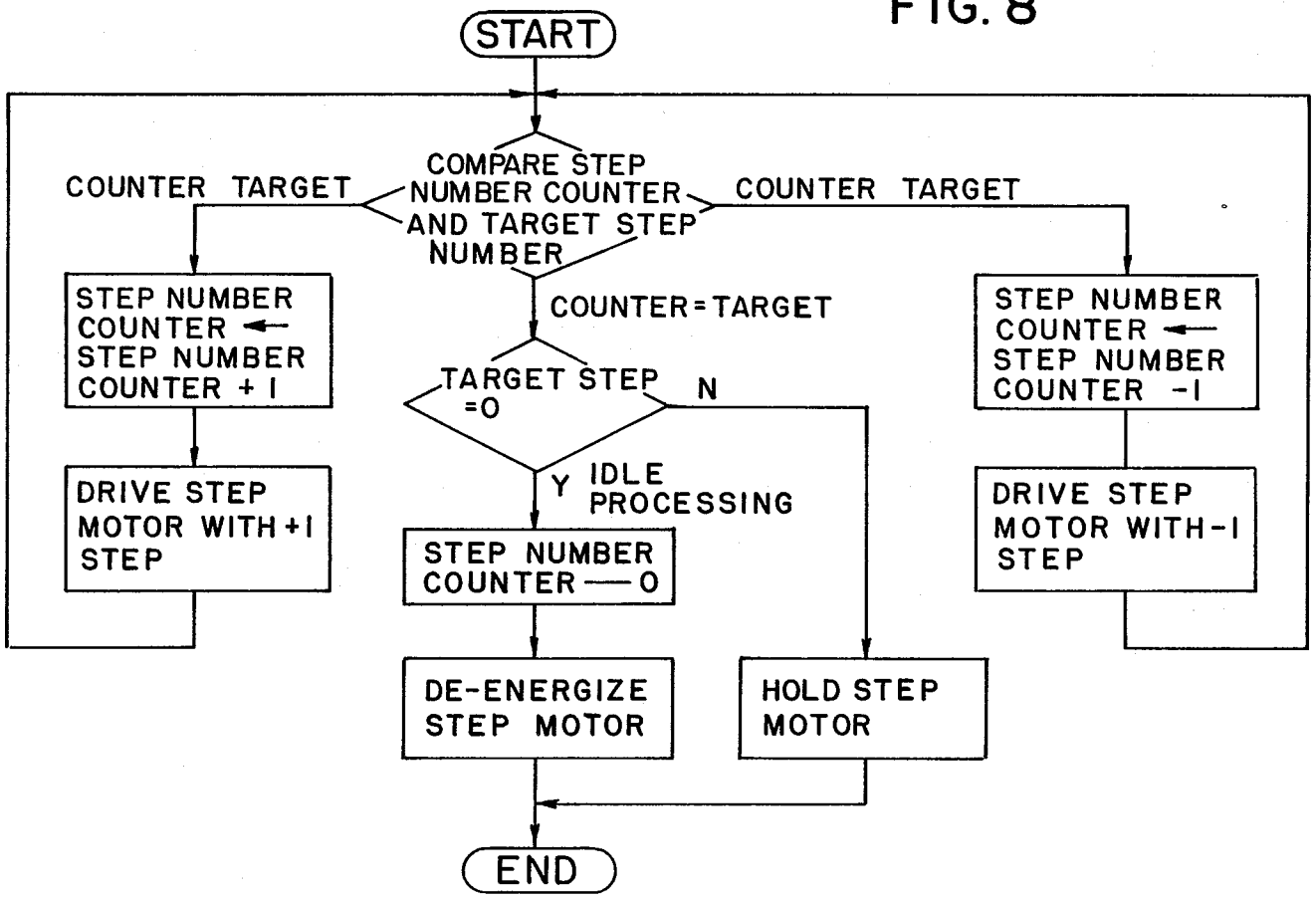
FIG. 8 is a flowchart of an operation sequence of the conventional arrangement.

FIG. 5 is a flowchart of an operation sequence of the fuel control system of the invention. The operation sequence will be described with reference to this flowchart.

(1) A target load opening is computed (step P1), and whether the load sensor is failing or not is checked (step P2). If the load sensor is normal, then a step P3 checks whether the relationship between the load opening and a step number conversion coefficient has already been learned or not. If yes, then the target load opening is converted to a target step number using the learned value (step P4). If no, then the target load opening is converted to a target step number using a back-up coefficient (step P5). The back-up coefficient is selected such that the maximum value of the converted target step number is a minimum value of variations in the angle of rotation of the control lever.

(2) Whether the target load is full load or not is checked (step P6). If it is full load, then a step P7 checks whether the load sensor is failing or not. If the load sensor is failing, then control goes to a step P14 and following steps. If the load sensor is normal, a step P8 ascertains whether the load sensor voltage is a prescribed full-load voltage or not. If it is a prescribed full-load voltage, then a step P9 checks whether the step motor has been rotated through a prescribed number of steps, for example 7 steps. If yes, then control goes to the step Pl4 and following steps. If no, a step P10 checks whether the step motor is rotating through 7 steps. If no in the step P10, then the number of steps between the idle and full-load positions is learned in a step P11, and a step number conversion coefficient with respect to the target load opening is computed from the learned value in a step P12 (the total number of steps from the idle to the full-load position/$FF).

If the load sensor voltage is not the prescribed full-load voltage in the step P8, and the step motor is rotating through 7 steps in the step p10, then the target step number is incremented by 1 (step P13).

(3) The step P14 checks whether the load sensor is failing. If it is normal, the step number for the present load sensor voltage is computed back in a step P15 using the present load sensor voltage, the step number conversion coefficient, and the learned idle voltage in order to detect a step-out condition. Then, a step P16 checks whether the estimation step number that is computed back is within a preset value from the value of the step number counter A2. If within the preset value, then it is judged that the step motor is not in a step-out condition. If in excess of the preset value, then it is determined that a step-out condition occurs, and the target steps are cleared to zero to reach the idle position, and then the step motor is rotated again in a step P17.

(4) If the target load is not full load in the step P6, then a step P18 ascertains whether the target load is the idle position or not. If no, control goes to the step P14 and following steps to see if the load sensor is failing. If yes in the step P18, then a step P19 ascertains whether the step motor is de-energized or not in order to learn the idle position. If the step motor is de-energized, then a step P20 checks if the load sensor is normal or not, and a step P21 checks if the load sensor voltage is within a preset value from the prescribed idle voltage or not. If yes, the idle voltage value is learned (step P22). The above embodiment is directed to the control of the step motor in an electronic fuel injection device. The present invention is however also applicable to the control of a rear engine of triples, and the control of a step motor for automatic cruise control using a mechanical governor.

The present invention offers the following advantages:

(1) In the vicinity of the idle position, the speed of rotation of the engine is greatly affected by a small difference between control lever angles. With the present invention, the fuel control system is capable of fine control by learning the idle position.

(2) The target lever position (target load) and the actual lever load can linearly be related to each other at all times between the idle and full-load positions without being affected by the control lever angle.

(3) A step-out condition can be detected by computing back the number of steps from the load sensor voltage and the step number conversion cofficient, and comparing the computed step number with the number of steps for the actual load sensor voltage.

(4) Since operation of the step motor is controlled by the number of step, normal control back-up from which special processing such as full-load processing is excluded can easily be effected even when the load sensor is dropped out of the system due to failure.

Although a certain preferred embodiment has been shown and described, it should be understood that many changes and modifications may be made therein without departing from the scope of the appended claims.

What we claim is:

1. A fuel control system for an internal combustion engine having fuel supply means for metering fuel to be supplied to the engine in response to an electric command given by fuel supply command means, said fuel control system comprising:

a step motor for driving a fuel metering member of said fuel supply means;

learning means for learning the number of steps required for energizing said step motor to move the fuel metering member from an idle position to a full-load position;

computing means for computing the number of steps required for said step motor to reach a target load position by dividing in proportion said learned number of steps by a ratio between a target load value of an electric command from said fuel supply command means and a maximum value of the electric command; and drive means for energizing said step motor to achieve the number of steps computed by said computing means.

2. A fuel control system for an internal combustion engine having fuel supply means for metering fuel to be supplied to the engine in response to an electric command given by fuel supply command means, said fuel control system comprising:

a step motor for driving a fuel metering member of the fuel supply means;

learning means for learning the number of steps required for energizing said step motor to move the fuel metering member from an idle position to a full-load position;

first computing means for computing the number of steps required for said step motor to reach a target load position by dividing in proportion said learned number of steps by a ratio between a target load value of an electric command from said fuel supply command means and a maximum value of the electric command;

drive means for energizing said step motor to achieve the number of steps computed by said computing means;

second computing means for determining the number of load estimation steps for said step motor to be driven to a prescribed position by dividing in proportion an electric maximum command from the fuel supply means by a ratio between the actual amount of rotation of said step motor and the amount of rotation from the idle position to the full-load position; and first detecting means for comparing the number of load estimation steps for said step motor computed by said second computing means and said number of steps computed by said first computing means, and for detecting a step-out condition of said step motor when the difference between the compared numbers is greater than a preset value.

3. A fuel control system according to claim 2, further including second detecting means for detecting the amount of rotation of said step motor, said second detecting means comprising a load sensor coupled to a drive shaft of said step motor.

4. A fuel control system according to claim 3, wherein the number of steps required for the step motor to move said fuel metering member from the idle position to the full-load position when the load sensor fails is replaced with a prescribed value capable of preventing the internal combustion engine from running out of control.

5. A fuel control system according to claim 2, further including second detecting means for detecting the amount of rotation of said step motor, said second detecting means comprising counter means for counting the number of steps through which said step motor rotates.

6. A fuel control system according to claim 2, further comprising means for de-energizing the step motor when a step-out condition of the step motor is detected.

7. A fuel control system according to claims 1 or 2, wherein said internal combustion engine comprises a gasoline engine.

8. A fuel control system according to claims 1 or 2, wherein said internal combustion engine comprises a diesel engine.

9. A fuel control system according to claims 1 or 2, wherein said fuel supply command means comprises a governor of a diesel engine.

10. A fuel control system according to claims 1 or 2, wherein said fuel supply command means comprises a carburetor of a gasoline engine.

* * * * *